US006696904B1

(12) United States Patent
Block et al.

(10) Patent No.: US 6,696,904 B1
(45) Date of Patent: Feb. 24, 2004

(54) DUPLEX/DIPLEXER HAVING TWO MODULARLY CONSTRUCTED FILTERS

(75) Inventors: Christian Block, Stainz (AT); Bernhard Reichel, Deutschlandsberg (AT)

(73) Assignee: Epcos AG, München (DE)

( * ) Notice: Subject to any disclaimer, the term of this patent is extended or adjusted under 35 U.S.C. 154(b) by 0 days.

(21) Appl. No.: 09/889,417

(22) PCT Filed: Jan. 26, 2000

(86) PCT No.: PCT/DE00/00218

§ 371 (c)(1),
(2), (4) Date: Oct. 6, 2001

(87) PCT Pub. No.: WO00/46871

PCT Pub. Date: Aug. 10, 2000

(30) Foreign Application Priority Data

Feb. 1, 1999 (DE) ..... 199 03 855

(51) Int. Cl.[7] ..... H01P 1/213; H01P 1/202
(52) U.S. Cl. ..... 333/134; 333/132; 333/206
(58) Field of Search ..... 333/134, 202, 333/206, 132, 207

(56) References Cited

U.S. PATENT DOCUMENTS 4,091,344 A * 5/1978 LaTourrette ..... 333/134
4,742,562 A * 5/1988 Kommrusch ..... 333/134
5,023,866 A * 6/1991 De Muro ..... 333/126
5,323,127 A * 6/1994 Komazaki et al. ..... 333/126
5,374,906 A * 12/1994 Noguchi et al. ..... 333/134
RE34,898 E * 4/1995 Turunen et al. ..... 333/206
5,422,610 A * 6/1995 Heine et al. ..... 333/134
5,534,829 A * 7/1996 Kobayashi et al. ..... 333/126
5,578,975 A * 11/1996 Kazama et al. ..... 333/134
5,652,555 A * 7/1997 Tada et al. ..... 333/202
5,686,873 A 11/1997 Tada et al. ..... 333/134
5,745,018 A * 4/1998 Vangala ..... 333/202
5,764,117 A * 6/1998 Tada et al. ..... 333/206
5,789,998 A 8/1998 Kim et al. ..... 333/134
5,790,001 A * 8/1998 Waldo et al. ..... 333/202
5,864,265 A * 1/1999 Ballance et al. ..... 333/129
5,949,308 A * 9/1999 Hino ..... 333/202
5,959,511 A * 9/1999 Pasco et al. ..... 333/134
6,188,299 B1 * 2/2001 Kawase et al. ..... 29/840

FOREIGN PATENT DOCUMENTS

DE 692 06 661 T2 5/1996
DE 195 34 158 C1 3/1997
DE 196 28 023 C1 6/1997
EP 0788182 A2 * 8/1997
JP 06164207 * 6/1994

* cited by examiner

*Primary Examiner*—Barbara Summons
(74) *Attorney, Agent, or Firm*—Schiff Hardin & Waite

(57) ABSTRACT

A duplexer/diplexer comprising at least a transmission branch and a reception branch. The transmission branch and the reception branch are modularly connected by shielding, and are arranged such that the two branches are matched to an identical value of resistance (50 Ohms) in their passband, and offer broadband high-impedance in the stopband of the band neighboring the passband. As a result, all three ports of the duplexer/diplexer are matched to the same value of resistance given parallel connection of the two branches.

5 Claims, 3 Drawing Sheets

DUPLEX/DIPLEXER HAVING TWO MODULARLY CONSTRUCTED FILTERS

BACKGROUND OF THE INVENTION

1. Field of the Invention

The present invention is directed to duplexer/diplexers, and in particular to duplexer/diplexer filters.

2. Discussion of the Related Art

Duplexers (transmission/reception duplexers) are devices for the separation of transmission and reception channels in systems employing a common transmission and reception antenna, in order to prevent energy from flowing into the receiver during transmission or to prevent energy from flowing into the transmitter during reception. Such duplexers are presently used in analog mobile radiotelephone systems, and their use is planned for future digital systems having high data rates.

Whereas duplexers have two branches, namely a transmission branch and a reception branch, duplexers are suited for separating different bands of different mobile radiotelephone systems (for example, DCS1800/PCS), and thus potentially may have more than two branches.

Specifically in mobile radiotelephone systems, the following demands are made of a duplexer that usually comprises two ceramic filters:

Optimally, insertion attenuations of the two branches should be low, in the transmission branch for example, in order to lose as little transmission power as possible in the filter itself. Selection between the two branches, however, should be optimally high in order to suppress generation of mixed products in the two branches. In addition to high suppression of mixed products, which are extremely undesirable precisely given a mobile radiotelephone device, the filters themselves should be as small as possible so that the duplexer does not occupy too much space.

Currently, there are two fundamentally different types of duplexers comprising ceramic filters.

The first type, which are referred to as monolithic duplexers, comprise a ceramic member wherein a transmission branch and a reception branch include a plurality of coupled resonators. The advantage of such a monolithic duplexer involves its manufacture; specifically only one ceramic member need be pressed in one piece, which considerably simplifies the manufacture compared to the production of two ceramic members. One disadvantage that should not be underestimated, however, is that the ceramic members of such monolithic duplexers are hard to solder due to their size, whereby corresponding mechanical stresses often arise on the supports or "boards", since the ceramic filters themselves are not flexible. Given monolithic duplexers, the harmonic behavior tends to be poorer compared to duplexers made up of separate filters, since the square-wave waveguide modes that fundamentally always occur, already become capable of propagation at low frequencies, which has an especially disadvantageous effect for a monolithic duplexer.

In the other type of duplexer, what are referred to as ceramic filters or ceramic line resonators, are coupled or mounted on a carrier substrate. Coupling structures between the ceramic filters are either contained in the carrier substrate or are established by additionally provided coils and capacitors. A critical disadvantage of this type of duplexer involves high cost outlay for the coupling structures.

Further, a reduction of the structural height due to the additional carrier substrate occurs at the expense of deterioration of the electrical parameters such as, in particular, the insertion attenuation.

SUMMARY OF THE INVENTION

It is an object of the present invention to provide a duplexer/diplexer that is simple to manufacture and to mount, and that can be easily matched to desired applications.

This object is inventively achieved in a duplexer/diplexer wherein filters are modularly constructed and connected by shielding, and wherein the two branches are matched to an identical value of resistance in their passband and offer broadband high-impedance in the stopband of the band neighboring the passband, so that all three ports of the duplexer/diplexer are matched to the value of resistance given parallel connection of the two branches.

It is another object of the invention to provide a duplexer/diplexer, that is modularly constructed. In a duplexer, the two branches are thereby arranged such that they are respectively matched to a resistance of 50 Ohms in the passband and are rotated high-impedance or, offer broadband no-load in the stopband of the band neighboring the passband. In other words, all three ports of the duplexer are matched to a resistance of 50 Ohms given parallel connection of the two branches.

If one of the two branches is not already high-impedance in the stopband based on its very structure, it can easily be rotated into no-load by means of a line structure at the side of the antenna port corresponding to its length in the "Smith diagram", i.e. the imaging of the right half of the impedance level onto the level of the complex reflection factor.

It is a further object of the invention to provide a duplexer/diplexer, wherein two or more branches can be fabricated independently of one another.

When the inventive duplexer is provided with roughly the same dimensions as an existing monolithic duplexer, as was explained above, then the two individual branches are each about half as large given the modular structure. By roughly double the frequency, the modular structure is significantly more advantageous with respect to the propagation capability of the first surface.

When, for example, there are limitations on the structural height, then there is the possibility of constructing the branches separately, thereby miniaturizing the reception branch, whereas the transmission branch is left as high as possible for maintaining the low insertion attenuation. Thus, a user is given latitude in the design.

All filters or duplexers/diplexers having coupled $\lambda/4$ resonators have the disadvantage that they become capable of propagation given the 3-fold frequency or a corresponding mixed product thereof. This situation can be advantageously alleviated by a side structure located at a distance of $\lambda/12$ from the front side of the respective filter or branch of the duplexer/diplexer.

Each filter is comprises a ceramic member wherein respective through bores are arranged that lead from one side of the respective ceramic member to the opposite side thereof, whereby terminal surfaces for three ports for the capacitative infeed/outfeed of RF signals insulated from a metallization of the ceramic member are provided on the ceramic member.

DETAILED DESCRIPTION OF THE PRESENTLY PREFERRED EMBODIMENTS

Figure 1:
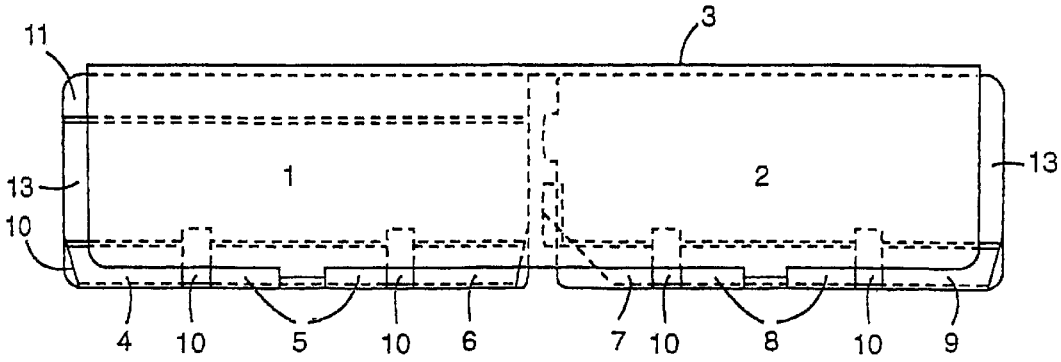
FIG. 1 a front view of the inventive duplexer.

FIG. 1 shows a front view of a duplexer 1 with a transmission branch 1 and a reception branch 2 that are both modularly constructed and connected by shielding, such as a sheet 3 of metal. The shielding 3 can be connected, for example, by welding. The transmission branch 1 and the reception branch 2 comprise a ceramic filter provided with metal terminal surfaces 4 through 6, or 7 through 9, that are electrically separated from one another and from metallization 11 by insulating gaps 10.

Through-bores 12 that can be designed in the standard way (see, for example, DE 195 34 158 C1 and DE 196 28 023 C1) extend through the ceramic bodies of transmission branch 1 and reception branch 2.

Figure 2:
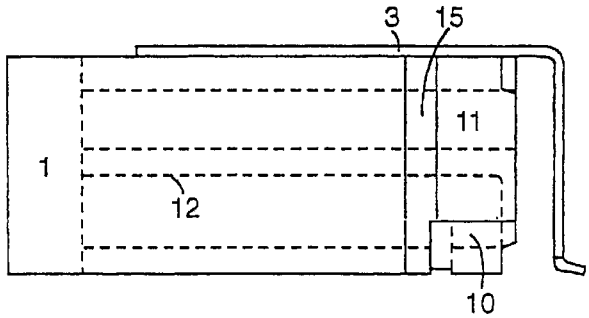
FIG. 2 a side view of the inventive duplexer.

The shielding 3 of metal is applied onto one of the metallization 11 and, as can be seen in the side view of FIG. 2, are conducted down at the front side of the two ceramic bodies of the two branches 1, 2 at a distance from this front side and are bent outward.

Figure 3:
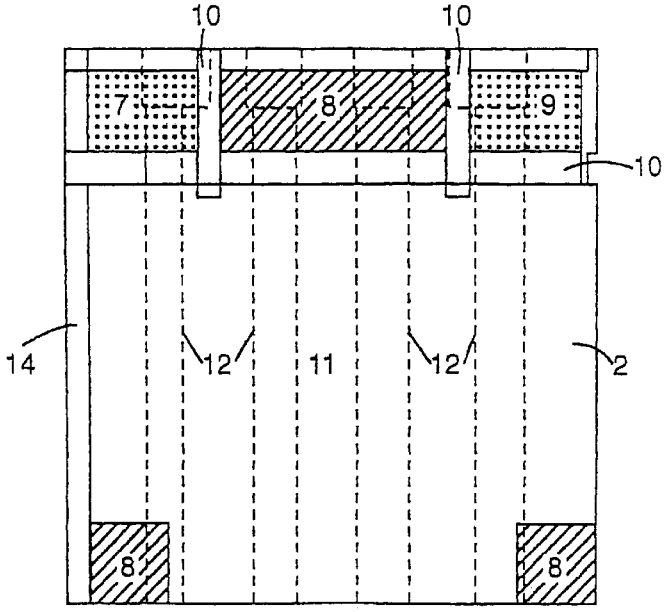
FIG. 3 a plan view onto a reception branch of the inventive duplexer.
Figure 4:
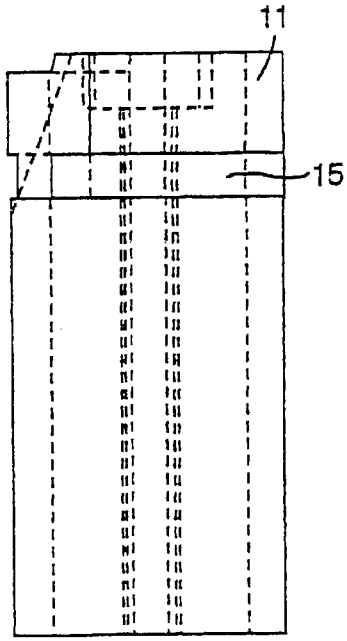
FIG. 4 a side view of the reception branch of FIG. 3.
Figure 5:
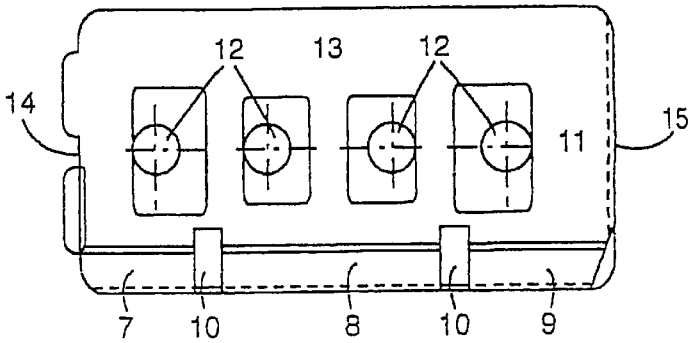
FIG. 5 a front view of the reception branch of FIG. 3.

FIG. 3 shows a plan view onto the reception branch 2 with the terminal surface 7 for the antenna, and the terminal surface 8 for ground and the reception terminal surface 9. Moreover, the four through bores 12 through the ceramic bodies of the reception branch 2 can be seen from this Figure. Regions around the openings of the through bores 12 at the surface of the ceramic body are free of the metallization 11 (see FIG. 5).

Figure 6:
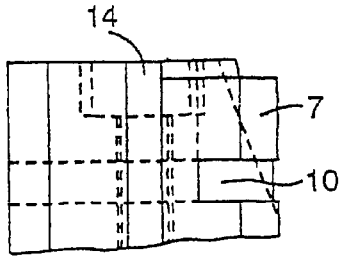
FIG. 6 a detail in the direction of view of an arrow A given the reception branch of FIG. 3.

An insulating gap 15 (also see FIG. 6) is located at a distance of $\lambda/12$ from the front side of the respective branch 1 or 2. Disadvantages can thus be overcome that are caused in that all filters or duplexers comprising coupled $\lambda/4$ resonators become capable of propagation given the 3-fold frequency or a corresponding mixed product thereof.

In the inventive duplexer/diplexer, a corresponding design of the bores and of the metallization 11, as well as a side structure 14 of metal effects that the two branches 1, 2, are matched to an identical value of resistance in their passband and offer broadband high-impedance in the stopband of the band neighboring the passband. The ceramic shape optimally suited for this purpose is found via appropriate molding and sintering settings. This value of resistance can preferably 50 Ohms.

Given parallel connection of the two branches 1, 2, all three ports established in the duplexer by the terminal surfaces 4 through 6, or 7 through 9, are then matched to the same value of resistance. The high impedance of the two branches 1, 2 in the stopband can be achieved by corresponding structuring of the antenna ports (see, for example, terminal surface 7) and corresponding implementation of the side structure 14.

Figure 7:
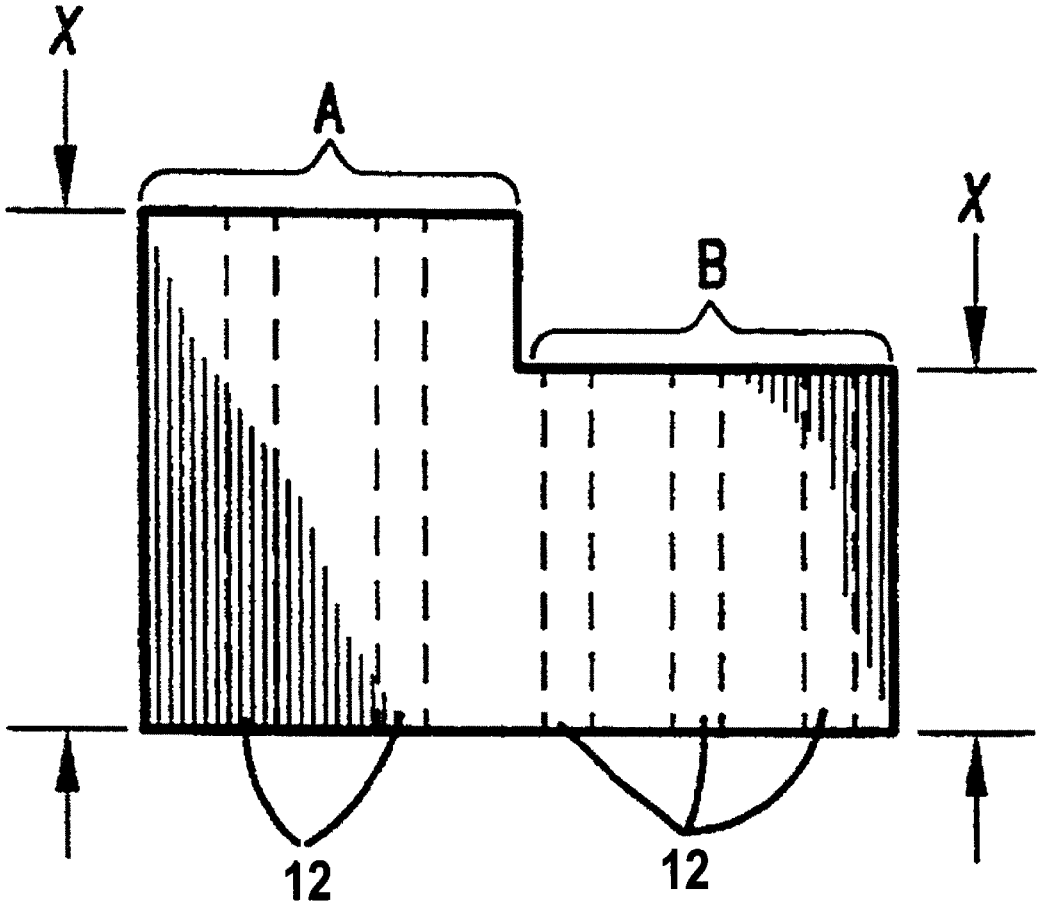
Fig. 7 (PRIOR ART)
FIG. 7 is a plan view onto a prior art multi-filter having branches comprising different heights.

The two branches 1, 2, or their ceramic bodies, can comprise different heights (similar to that illustrated by prior art FIG. 7). For example, it is thus possible that the reception branch 2 is miniaturized, whereas the transmission branch 1 is left as high as possible for maintaining a low insertion attenuation.

Filters having branches comprising different heights are known from, e.g., Heine, et al. U.S. Pat. No. 5,422,610 as illustrated in FIG. 1 of Heine and replicated in FIG. 7 of the present application.

Although modifications and changes may be suggested by those skilled in the art to which this invention pertains, it is the intention of the inventors to embody within the patent warranted hereon all changes and modifications that may reasonably and properly come under the scope of their contribution to the art.

What is claimed is:

1. A duplexer/diplexer, comprising:

at least two filters for a transmission branch and a reception branch;

each of said at least two filters comprising a ceramic body in which respective through-bores are arranged, said through bores leading from one side of the ceramic body to the opposite side thereof; and terminal surfaces insulated from a metalization of the ceramic body are provided on the ceramic body for three ports for the capacitative infeed/outfeed of RF signals, wherein:

said filters are modularly constructed and connected by a shielding of metal that is applied onto the metalization and the two branches are matched to an identical value of resistance in their passband and offer broadband high-impedance in the stopband of the band neighboring the passband, so that all three ports of the duplexer/diplexer are matched to the value of resistance when in parallel connection of the two branches; and the high impedance of the branches in the stopband is achieved by structuring of the ports and by a metal side structure arranged on a side surface of only one filter, the metal side structure being configured as a line structure of a length necessary to achieve high-impedance in the stopband.

2. The duplexer/diplexer according to claim 1, wherein the value of resistance is 50 Ohms.

3. The duplexer/diplexer according to claim 2, wherein the branches comprise different heights.

4. The duplexer/diplexer according to claim 1, wherein each filter comprises $\lambda/4$ resonators and an insulating gap is located at a distance of $\lambda/12$ from a front side of the respective filter.

5. A duplexer/diplexer, comprising:

at least two filters for a transmission branch and a reception branch;

each of said at least two filters comprising a ceramic body in which respective through-bores are arranged, said through bores leading from one side of the ceramic body to the opposite side thereof; and terminal surfaces insulated from a metalization of the ceramic body are provided on the ceramic body for three ports for the capacitative infeed/outfeed of RF signals, wherein:

said filters are modularly constructed and connected by a shielding of metal that is applied onto the metalization and the two branches are matched to an identical value of resistance in their passband and offer broadband high-impedance in the stopband of the band neighboring the passband, so that all three ports of the duplexer/diplexer are matched to the value of resistance when in parallel connection of the two branches;

the high impedance of the branches in the stopband is achieved by structuring of the ports and by a metal side structure;

the value of resistance is 50 Ohms;

the branches comprise different heights;

at least one filter comprises a metal side structure; and each filter comprises $\lambda/4$ resonators and an insulating gap is located at a distance of $\lambda/12$ from a front side of the respective filter.

* * * * *